US010772448B2

(12) United States Patent
Bradshaw

(10) Patent No.: US 10,772,448 B2
(45) Date of Patent: Sep. 15, 2020

(54) APPARATUS FOR SUPPORTING BEVERAGE CONTAINERS

(71) Applicant: Scott M. Bradshaw, Wingdale, NY (US)

(72) Inventor: Scott M. Bradshaw, Wingdale, NY (US)

( * ) Notice: Subject to any disclaimer, the term of this patent is extended or adjusted under 35 U.S.C. 154(b) by 41 days.

(21) Appl. No.: 16/361,305

(22) Filed: Mar. 22, 2019

(65) Prior Publication Data

US 2019/0320832 A1 Oct. 24, 2019

Related U.S. Application Data

(60) Provisional application No. 62/661,677, filed on Apr. 24, 2018.

(51) Int. Cl.

| | |
|---|---|
| ***A47G 23/06*** | (2006.01) |
| ***A47G 23/02*** | (2006.01) |
| ***B65D 1/34*** | (2006.01) |
| ***A47G 23/03*** | (2006.01) |

(52) U.S. Cl.

CPC ..... *A47G 23/0633* (2013.01); *A47G 23/0208* (2013.01); *A47G 23/0313* (2013.01); *B65D 1/34* (2013.01); *A47G 2023/0275* (2013.01)

(58) Field of Classification Search

CPC ..... A47G 23/0633; A47G 23/06; A47G 23/0225; A47G 23/0216; A47G 23/0208; A47G 23/0313; B65D 1/34; B65D 81/3876

USPC ..... 220/574, 556, 739, 737, 647, 646, 630, 220/628; 206/562, 563, 564

See application file for complete search history.

(56) References Cited

U.S. PATENT DOCUMENTS

| | | | |
|---|---|---|---|
| 4,919,381 | A | 4/1990 | Buist |
| 8,025,146 | B2 | 9/2011 | Willis et al. |
| 2006/0249520 | A1 | 11/2006 | DeMonte |
| 2016/0213137 | A1 | 7/2016 | Sellars |

*Primary Examiner* — Robert J Hicks

(74) *Attorney, Agent, or Firm* — Law Offices of Michael L. Wise, LLC

(57) ABSTRACT

A kit for use with a beverage includes: a sleeve, an interior plate, an engaging feature, a connector, and a support element. The sleeve forms an interior volume dimensioned to contain a beverage. The interior plate is located within the interior volume. The engaging feature is located outside the interior volume and includes an upper sidewall and a lower sidewall. The connector penetrates the bottom and interconnects the interior plate and the engaging feature. Lastly, the support element includes a receiving feature shaped to engage with the engaging feature such that at least part of the receiving feature is positioned between the upper sidewall and the lower sidewall. Configured in this manner, the support element, which may be in the form of a serving tray, is capable of safely and securely supporting beverages in an upright position.

17 Claims, 4 Drawing Sheets

APPARATUS FOR SUPPORTING BEVERAGE CONTAINERS

FIELD OF THE INVENTION

The present invention relates generally to table equipment, and, more particularly, to apparatus for supporting beverage containers.

BACKGROUND OF THE INVENTION

When eating while standing or in a dynamic environment such as on a boat, it is often difficult to simultaneously hold a plate of food, eat from that plate, and support a beverage. Instead, one must try to find a place to safely place the beverage while eating, and this often leads to spillage and other accidents.

As a result, there have been several attempts to develop mechanical systems that can aid in safely supporting a beverage container without use of hands. Such systems are described in, for example: US Patent Application Publication No. 2006/0249520; and U.S. Pat. Nos. 4,919,381; 8,025,146; and 9,578,954. Nevertheless, each of these systems suffers from one or more of the following disadvantages: being overly complicated, requiring the use of purpose-specific beverage containers, being expensive to produce, and being inconvenient to use.

For the foregoing reasons, there is a need for improved apparatus for supporting beverages that address these shortcomings.

SUMMARY OF THE INVENTION

Embodiments of the present invention address the above-identified needs by providing apparatus that allow beverages to be safely and securely supported in an upright position.

Aspects of the invention are directed to a kit for use with a beverage container. The kit comprises: a sleeve, an interior plate, an engaging feature, a connector, and a support element. The sleeve defines an interior volume dimensioned to contain at least a portion of the beverage container. The interior plate is disposed within the interior volume. The engaging feature is disposed outside the interior volume and defines an upper sidewall and a lower sidewall. The connector penetrates the bottom and interconnects the interior plate and the engaging feature. The support element defines a receiving feature shaped to engage with the engaging feature such that at least part of the receiving feature is positioned between a portion of the upper sidewall and a portion of the lower sidewall.

Additional aspects of the invention are directed to an apparatus comprising: a beverage container, a beverage holder, and a serving tray. The beverage holder comprises a sleeve, an interior plate, an engaging feature, and a connector. The sleeve defines an interior volume dimensioned to contain at least a portion of the beverage container. The interior plate is disposed within the interior volume. The engaging feature is disposed outside the interior volume and defines an upper exterior plate and a lower exterior plate. The connector penetrates the bottom and interconnects the interior plate and the engaging feature. The serving tray defines a receiving feature engaging with the engaging feature such that at least part of the receiving feature is positioned between a portion of the upper sidewall and a portion of the lower sidewall.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, the term "plate" is not restricted to planar or flat objects and is not restricted to objects that are necessarily circular. Rather, the term "plate" is to be interpreted broadly and may encompass sheets of metal or other materials that are formed so as to be non-planar and/or non-circular. Moreover, the term "discrete," when applied to two elements, means that those elements are not formed of a single piece of material, but instead are formed from two pieces of material that are separate from each other immediately after their manufacture. "Substantially parallel" means parallel within plus or minus ten degrees. Finally, two or more elements "are substantially identical in shape" if they are identical in shape within the ordinary and customary manufacturing tolerances used in their production.

Figure 1:
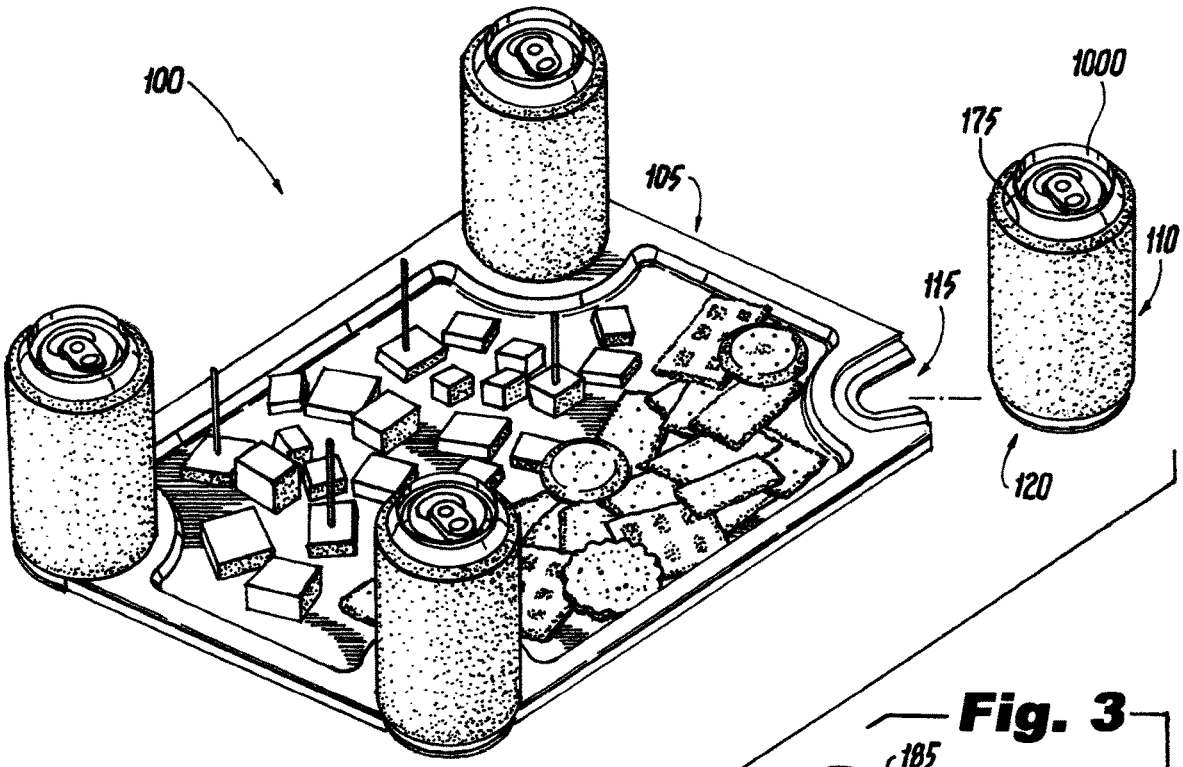
FIG. 1 shows a perspective view of an illustrative apparatus in accordance with aspects of the invention.

FIG. 1 shows a perspective view of an illustrative apparatus (or kit) 100 in accordance with aspects of the invention. The apparatus 100 comprises a serving tray 105 and four drink holders 110. Each of the drink holders 110 encloses a respective beverage can 1000. As will be described in greater detail below, each corner of the serving tray 105 defines a receiving feature 115 that is shaped to engage with engaging features 120 on the bottoms of the drink holders 110. So configured, the drink holders 110 may be slid onto the receiving features 115 of the serving tray 105, allowing the serving tray 105 to securely support the beverage cans 1000 in an upright position.

Figure 2:
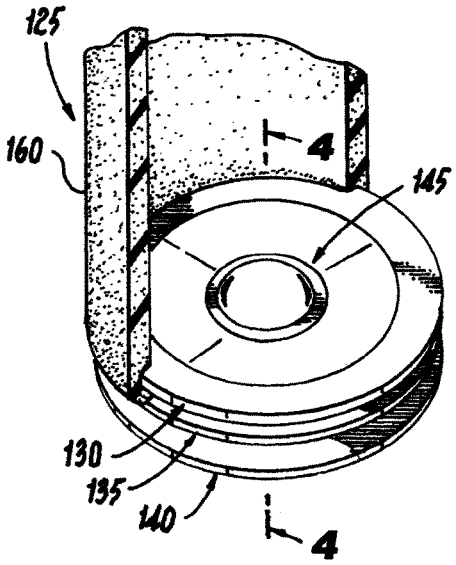
FIG. 2 shows a broken perspective view of a lower portion of a drink holder in the FIG. 1 apparatus.
Figure 3:
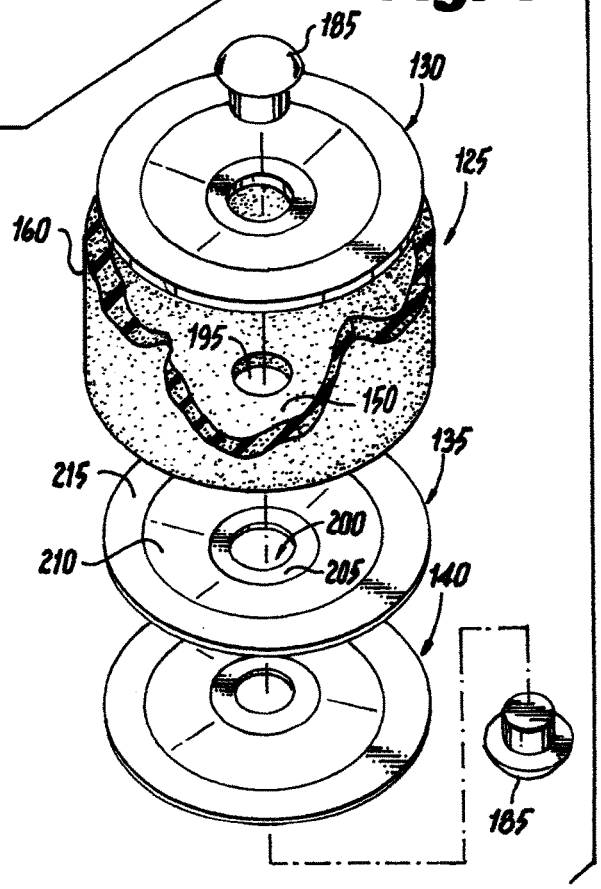
FIG. 3 shows an exploded broken perspective view of the FIG. 2 drink holder portion.
Figure 4:
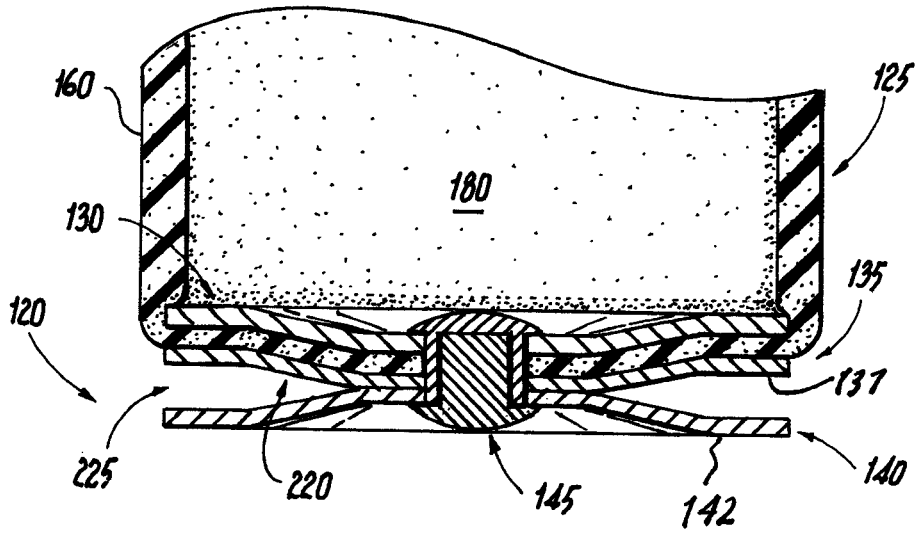
FIG. 4 shows a sectional view of the FIG. 2 drink holder portion.

FIGS. 2-4 show aspects of a representative one of the drink holders 110, with FIG. 2 showing a broken perspective view of a lower portion of the drink holder 110, FIG. 3 showing an exploded broken perspective view, and FIG. 4 showing a sectional view. The drink holder 110 comprises a sleeve 125, an interior plate 130, an upper exterior plate 135, a lower exterior plate 140, and a connector 145. The sleeve 125, in turn, comprises a bottom 150, a cylindrical sidewall 160, and an open top 175, which combine to define an interior volume 180. The connector 145, comprising two engaging rivet parts 185, penetrates a hole 195 in the bottom 150 of the sleeve 125, and acts to interconnect the interior plate 130, the upper exterior plate 135, and the lower exterior plate 140. The various plates 130, 135, 140 are thereby stacked upon each other with the bottom 150 of the sleeve 125 separating the interior plate 130 from the exterior plates 135, 140.

The sleeve 125 is dimensioned such that the beverage can 1000 may be placed into the interior volume 180 above the interior plate 130. The sleeve 125 may be formed of a flexible, thermally insulating material, making the sleeve 125 similar to what is sometimes called a "koozie," "coozy," or "coozie." In fact, aspects of the invention may be retrofittable to already-existing, conventional sleeves. The thermally insulating properties of the sleeve 125 help to maintain the beverage contained therein at the desired temperature, whether hot or cold.

In the present illustrative embodiment, the interior plate 130, the upper exterior plate 135, and the lower exterior plate 140 are substantially identical in shape. Each comprises a respective annular element with a center opening 200 surrounded by a flat inside region 205, an angled center region 210, and a flat outside region 215. Both the interior plate 130 and the upper exterior plate 135 are oriented in a like direction, while the lower exterior plate 140 is oriented in the opposite direction. So oriented, the upper exterior plate 135 and the lower exterior plate 140 combine to create the engaging feature 120. The engaging feature 120 defines an upper sidewall 137 formed by the upper exterior plate 135 and a lower sidewall 142 formed by the lower exterior plate 140 (FIG. 4). At the same time, when considered in cross-section, the engaging feature 120 defines an open inside region 220 bordered by angled portions of the upper and lower sidewalls 137, 142 that form a v-shape, surrounded by an open outside region 225 bordered by substantially parallel portions of the upper and lower sidewalls 137, 142. In this manner, the drink holder 110 defines a uniquely shaped "clip" for use in securing the drink holder 110 to the serving tray 105. Advantageously, the drink holder 110 may also be rested on this clip on any flat surface if, for whatever reason, the serving tray 105 is not used for support.

Figure 5:
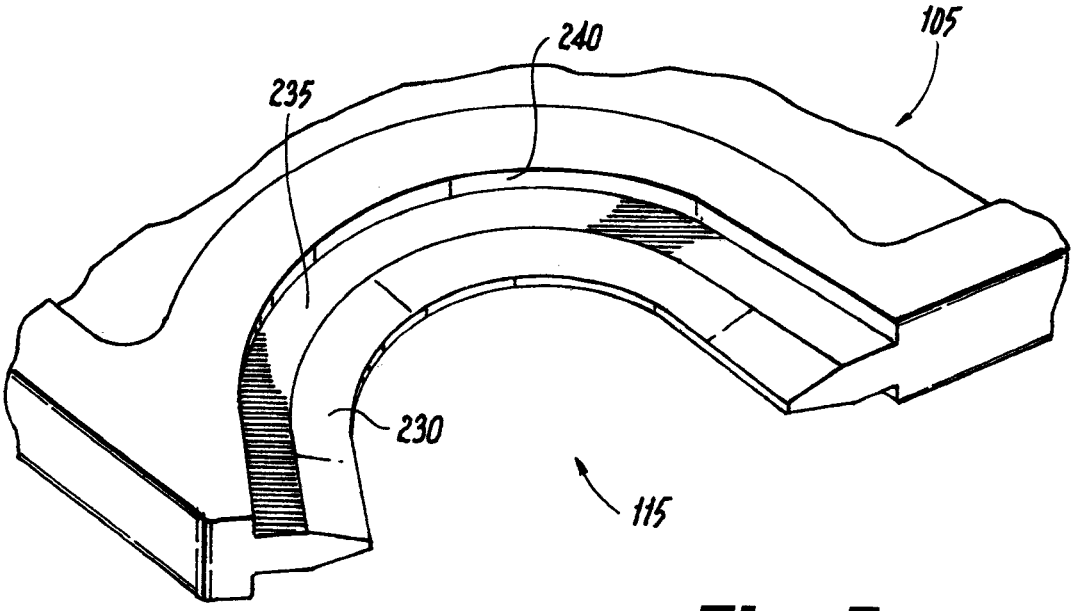
FIG. 5 shows a perspective view of a receiving feature in the FIG. 1 apparatus.

The receiving features 115 of the serving tray 105 are designed to slidably engage with the uniquely shaped engaging features 120 of the drink holders 110. FIG. 5 shows a perspective view of a representative one of the receiving features 115. The receiving feature 115 is arc-shaped. When considered in cross-section, the receiving feature 115 defines a solid inside region 230 having angled upper and lower surfaces that form a v-shape, surrounded by a solid outside region 235 having substantially parallel upper and lower surfaces. In so doing, the receiving feature 115 defines a shape that, at least in cross-section, is essentially inverse to that of the engaging feature 120. A step 240 borders the solid outside region 235 and is the transition into the remainder of the serving tray 105.

Figure 6:
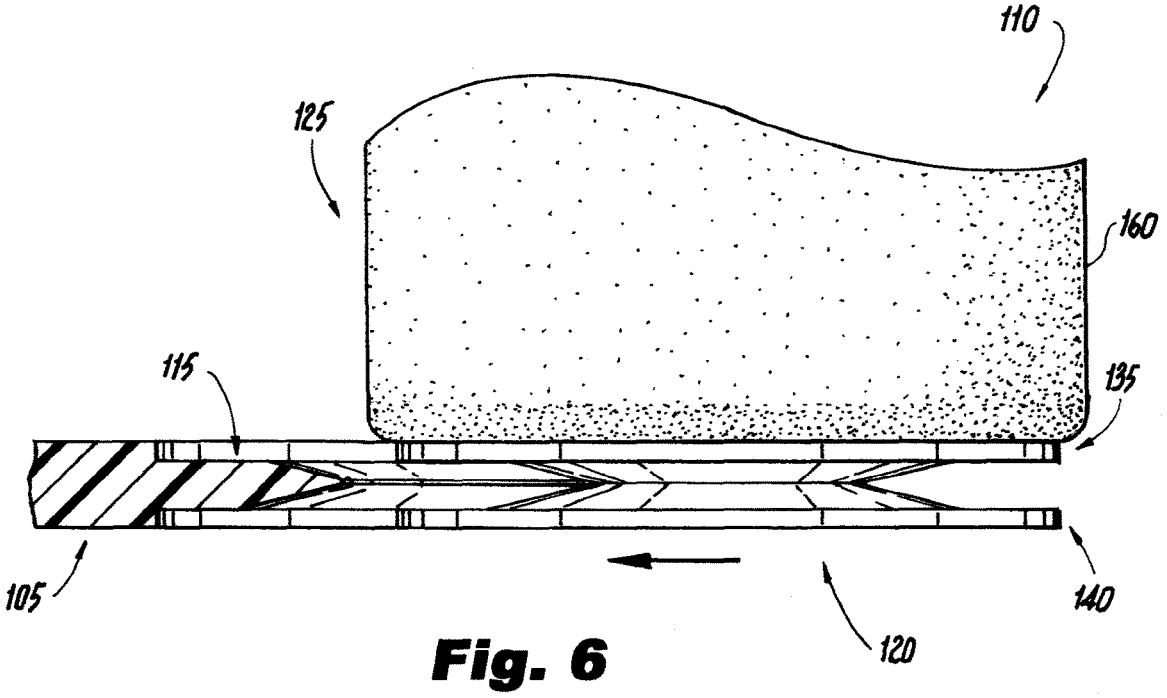
FIGS. 6 and 7 show broken side views of the FIG. 2 drink holder portion engaging a receiving feature in the FIG. 1 apparatus.
Figure 7:
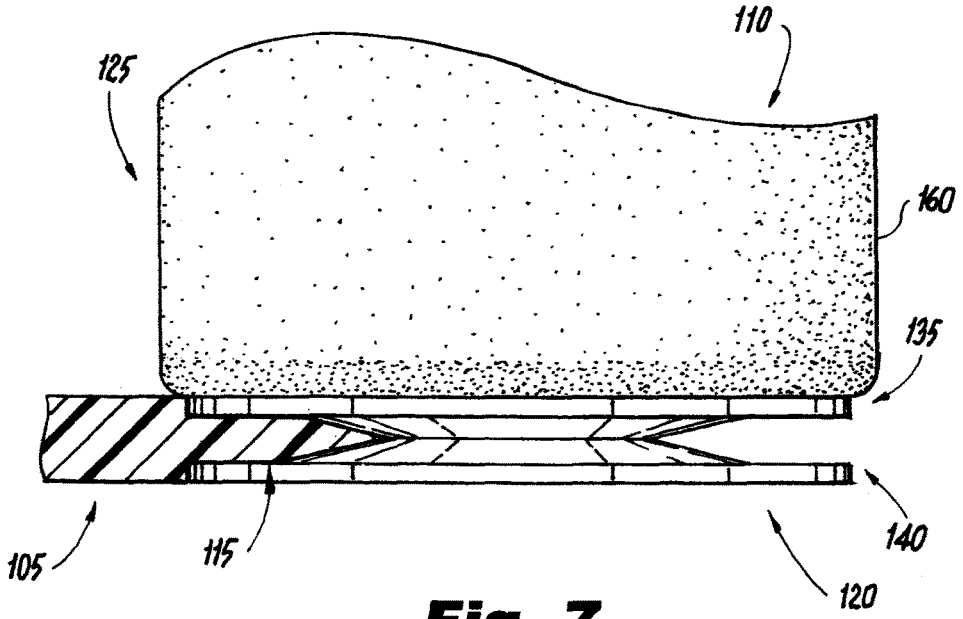

FIGS. 6 and 7 show broken side views of the bottom portion of the representative drink holder 110 engaging a representative receiving feature 115 on the serving tray 105. In FIG. 6, the drink holder 110 is partially engaged on the serving tray 105, while in FIG. 7, the drink holder 110 is fully engaged. When engaged with the engaging feature 120, part of the receiving feature 115 is positioned between a portion of the upper sidewall 137 and a portion of the lower sidewall 142.

Once understood from the description provided herein, the various elements of the apparatus 100 may be formed using conventional materials and conventional manufacturing techniques that will already be familiar to one having ordinary skill in the relevant arts. The sleeve 125 may be formed of, for example, leather, neoprene, ethylene-vinyl acetate (EVA), vinyl, and various open-cell and closed-cell foams. The various interior and exterior plates 130, 135, 140 may be formed of, for instance, metal, plastic, or other materials, and may have an outside diameter of about 2½ inches. The rise in the interior and exterior plates 130, 135, 140 defined by the angling of these features may be, for example, about ¼ inch. Nevertheless, despite the recitation of these particular materials and dimensions herein, it is again emphasized that these materials and dimension are solely provided for illustrative purposes and are not intended to limit the scope of the invention. Other materials and dimensions would also come within the scope of the invention.

It should again be emphasized that the above-described embodiments of the invention are intended to be illustrative only. Other embodiments can use different types and arrangements of elements for implementing the described functionality. These numerous alternative embodiments will be apparent to one skilled in the art.

For example, while the sleeve 125 in the illustrative embodiment set forth above encloses a beverage can 1000, alternative embodiments may be dimensioned to encompass other types of beverage containers, including, but not limited to, bottles and cups. Alternatively or additionally, while a particular rivet-like connector 145 was presented above, the connector in alternative embodiments may take on many other forms including, as just one example, a bolt and nut arrangement (with one or more washers if so desired), Chicago screws, and the like. In even other embodiments, the engaging feature 120 may be formed of a single, continuous piece of material rather than being formed of separate plates 135, 140.

Figure 8:
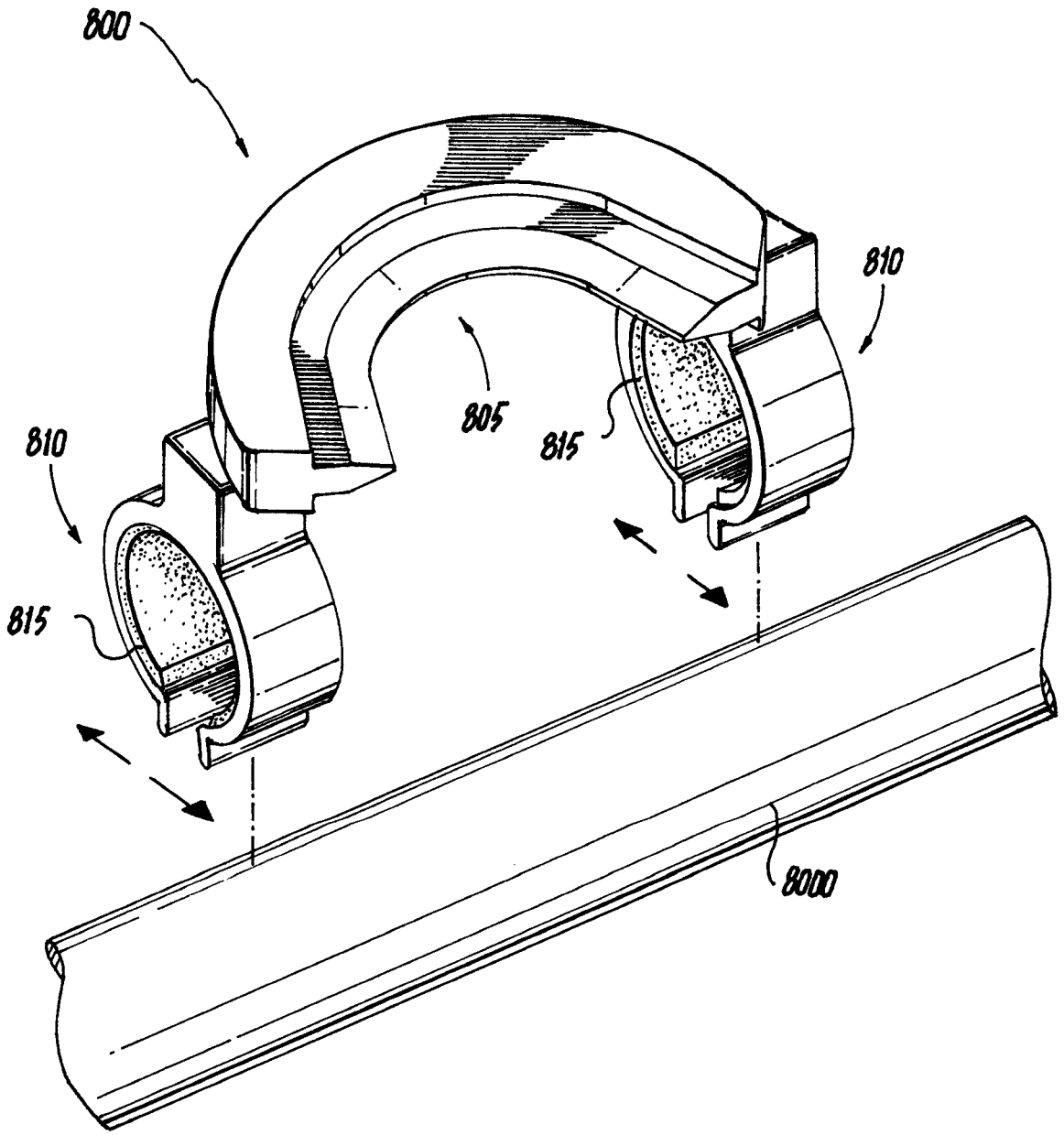
FIG. 8 shows a perspective view of an alternative illustrative support element in association with a round cylindrical railing, in accordance with an illustrative embodiment of the invention.

Moreover, while the above-described illustrative embodiment utilizes a serving tray 105 as a support element for the drink holders 110, other embodiments falling within the scope of the invention may utilize many alternative forms of support elements. FIG. 8 shows a perspective view of an alternative illustrative support element 800 in association with a round cylindrical railing 8000 like that found on a boat. The alternative support element 800 defines an arc-shaped receiving feature 805 similar in shape to the receiving feature 115, allowing the alternative support element 800 to be used with a drink holder like the drink holders 110 set forth above. Mounting of the alternative support element 800 to the railing 8000 is via two somewhat-elastic round clips 810 that are shaped to allow the alternative support element 800 to be manually clipped onto the railing 8000 and held in place by compression. Elastomeric pads 815 (formed of, e.g., rubber) attached to internal surfaces of the clips 810 stop the clips 810 from marring the railing 8000 and also provide additional friction to keep the alternative support element 800 upright.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Any element in a claim that does not explicitly state "means for" performing a specified function or "step for" performing a specified function is not to be interpreted as a "means for" or "step for" clause as specified in AIA 35 U.S.C. § 112(f). In particular, the use of "steps of" in the claims herein is not intended to invoke the provisions of AIA 35 U.S.C. § 112(f).

What is claimed is:

1. A kit for use with a beverage container, the kit comprising:

a sleeve comprising a bottom, a cylindrical sidewall, and an open top, the sleeve defining an interior volume dimensioned to contain at least a portion of the beverage container;

an interior plate disposed within the interior volume;

an engaging feature disposed outside the interior volume and defining an upper sidewall and a lower sidewall;

a connector penetrating the bottom and interconnecting the interior plate and the engaging feature; and a support element defining a receiving feature shaped to engage with the engaging feature such that at least part of the receiving feature is positioned between a portion of the upper sidewall and a portion of the lower sidewall.

2. The kit of claim 1, wherein the sleeve is dimensioned to contain at least a portion of a beverage can, bottle, or cup.

3. The kit of claim 1, wherein the sleeve is formed from a flexible, thermally insulating material.

4. The kit of claim 1, wherein the engaging feature is annular.

5. The kit of claim 1, wherein the engaging feature comprises:

a lower exterior plate defining the lower sidewall; and an upper exterior plate defining the upper sidewall and discrete from the lower exterior plate.

6. The kit of claim 5, wherein the interior plate, the lower exterior plate, and the upper exterior plate are substantially identical in shape.

7. The kit of claim 1, wherein the engaging feature defines an open inside region bordered by angled portions of the upper sidewall and lower sidewall that form a v-shape, surrounded by an open outside region bordered by substantially parallel portions of the upper sidewall and the lower sidewall.

8. The kit of claim 1, wherein the connector comprises a rivet, a nut-and-bolt, or a Chicago screw.

9. The kit of claim 1, wherein the support element is a serving tray.

10. The kit of claim 1, wherein the receiving feature is arc-shaped.

11. The kit of claim 1, wherein the support element further defines an additional receiving feature in spaced relation to the receiving feature and shaped to engage with the engaging feature.

12. The kit of claim 1, wherein the support element is adapted to be mounted to a cylindrical railing.

13. The kit of claim 12, further comprising a round clip attached to the support element, the round clip adapted to be manually clippable onto the cylindrical railing.

14. The kit of claim 13, further comprising an elastomeric pad attached to an internal surface of the round clip.

15. The kit of claim 1, wherein the receiving feature defines a solid inside region having angled upper and lower surfaces that form a v-shape, surrounded by a solid outside region having substantially parallel upper and lower surfaces.

16. An apparatus comprising:

a beverage container;

a beverage holder comprising:

a sleeve comprising a bottom, a cylindrical sidewall, and an open top, the sleeve defining an interior volume dimensioned to contain at least a portion of the beverage container;

an interior plate disposed within the interior volume;

an engaging feature disposed outside the interior volume and defining an upper sidewall and a lower sidewall; and a connector penetrating the bottom and interconnecting the interior plate and the engaging feature; and a serving tray defining a receiving feature engaging with the engaging feature such that at least part of the receiving feature is positioned between a portion of the upper sidewall and a portion of the lower sidewall.

17. The apparatus of claim 16, wherein the serving tray further defines an additional receiving element in spaced relation to the receiving feature and shaped to engage with the engaging feature.

* * * * *